US008038934B2

(12) United States Patent
Kochi et al.

(10) Patent No.: US 8,038,934 B2
(45) Date of Patent: Oct. 18, 2011

(54) HIGH-STRENGTH SPRING STEEL EXCELLENT IN BRITTLE FRACTURE RESISTANCE AND METHOD FOR PRODUCING SAME

(75) Inventors: Takuya Kochi, Kobe (JP); Hiroshi Yaguchi, Kobe (JP); Wataru Urushihara, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 546 days.

(21) Appl. No.: 12/160,913

(22) PCT Filed: Jan. 23, 2007

(86) PCT No.: PCT/JP2007/050969
§ 371 (c)(1),
(2), (4) Date: Jul. 15, 2008

(87) PCT Pub. No.: WO2007/083808
PCT Pub. Date: Jul. 26, 2007

(65) Prior Publication Data

US 2010/0224287 A1 Sep. 9, 2010

(30) Foreign Application Priority Data

Jan. 23, 2006 (JP) ..... 2006-013471

(51) Int. Cl.

| | |
|---|---|
| ***C22C 38/18*** | (2006.01) |
| ***C22C 38/00*** | (2006.01) |
| ***C22C 38/60*** | (2006.01) |
| ***C22C 38/02*** | (2006.01) |
| ***C21D 11/00*** | (2006.01) |
| ***C21D 9/02*** | (2006.01) |

(52) U.S. Cl. ..... 420/104; 420/83; 420/84; 420/115; 420/117; 148/328; 148/331; 148/333; 148/504; 148/580; 148/908

(58) Field of Classification Search ..... 148/328, 148/333, 504, 580, 908, 331; 420/104, 115, 420/83, 84, 117
See application file for complete search history.

(56) References Cited

U.S. PATENT DOCUMENTS 7,037,387 B2 5/2006 Nagao et al.

(Continued)

FOREIGN PATENT DOCUMENTS

EP 1 619 264 A1 1/2006

(Continued)

OTHER PUBLICATIONS

Kubota et al., English machine translation of JP 2004-143482, May 2004.*

(Continued)

*Primary Examiner* — Roy King
*Assistant Examiner* — Caitlin Kiechle
(74) *Attorney, Agent, or Firm* — Oblon, Spivak, McClelland, Maier & Neustadt, L.L.P.

(57) ABSTRACT

A spring steel having a high strength of 1900 MPa or more and superior in the brittle fracture resistance, as well as a method for manufacturing the same, are provided.
The high strength spring steel comprises, as basic components in mass %, C: 0.4-0.6%, Si: 1.4-3.0%, Mn: 0.1-1.0%, Cr: 0.2-2.5%, P: 0.025% or less, S: 0.025% or less, N: 0.006% or less, Al: 0.1% or less, and O: 0.003% or less, the amount of solute C being 0.15% or less, the amount of Cr contained as a Cr-containing precipitate being 0.10% or less, and a TS value represented by the following equation being 24.8% or more, and in point of structure, the pre-austenite grain diameter being 10 μm or smaller, wherein TS=28.5*[C]+4.9*[Si]+0.5*[Mn]+2.5*[Cr]+1.7*[V]+3.7*[Mo] where [X] stands for mass % of element X.

20 Claims, 3 Drawing Sheets

U.S. PATENT DOCUMENTS

| | | | | |
|---|---|---|---|---|
| 2006/0048864 | A1 | 3/2006 | Nagao et al. | |
| 2006/0130946 | A1 * | 6/2006 | Minamida et al. | 148/595 |
| 2006/0196584 | A1 | 9/2006 | Kochi et al. | |
| 2006/0201588 | A1 | 9/2006 | Suda et al. | |
| 2007/0125456 | A1 | 6/2007 | Kochi et al. | |
| 2007/0277913 | A1 | 12/2007 | Kochi et al. | |
| 2008/0156403 | A1 | 7/2008 | Masuda et al. | |

FOREIGN PATENT DOCUMENTS

| | | | |
|---|---|---|---|
| JP | 6 306542 | | 11/1994 |
| JP | 7 179996 | | 7/1995 |
| JP | 8-134545 | | 5/1996 |
| JP | 9-41079 | | 2/1997 |
| JP | 10 121201 | | 5/1998 |
| JP | 11302784 | A * | 11/1999 |
| JP | 2000 169937 | | 6/2000 |
| JP | 2001-247936 | | 9/2001 |
| JP | 2002-212665 | | 7/2002 |
| JP | 2003 3241 | | 1/2003 |
| JP | 2003 105485 | | 4/2003 |
| JP | 2003 213372 | | 7/2003 |
| JP | 2003 306747 | | 10/2003 |
| JP | 2004 143482 | | 5/2004 |
| JP | 2004 315968 | | 11/2004 |

OTHER PUBLICATIONS

Bates et al., ASM Handbook-Quenching of Steel and Tempering of Steel, 2002, ASM International, vol. 4, p. 1-133.*

Ishikawa et al., English machine translation of JP 11-302784, Nov. 2, 1999, whole document.*

U.S. Appl. No. 12/466,865, filed May 15, 2009, Kochi, et al.

U.S. Appl. No. 12/063,324, filed Feb. 8, 2008, Kuroda, et al.

U.S. Appl. No. 12/192,437, filed Aug. 15, 2008, Kochi, et al.

* cited by examiner

HIGH-STRENGTH SPRING STEEL EXCELLENT IN BRITTLE FRACTURE RESISTANCE AND METHOD FOR PRODUCING SAME

TECHNICAL FIELD

The present invention relates to a spring steel having a high strength of 1900 MPa or more and particularly having an improved brittle fracture resistance.

BACKGROUND ART

Recently, technical developments for attaining a high fuel economy of automobiles have been conducted actively from the standpoint of diminishing the environmental load. AS to the valve spring and suspension spring which are automobile parts, studies are being made about an increase of design stress and the reduction of size. In this connection, the spring steel used is required to have a high strength. Generally, however, when metallic materials are rendered high in strength, their brittle fracture resistance typified by fatigue and delayed fracture is deteriorated. Therefore, for attaining a high strength, it is required to make it compatible with the resistance to fracture.

To meet such a requirement, for example in Japanese Patent Laid-open (JP-A) No. 06-306542 there is proposed a spring steel improved in fatigue strength by controlling the composition of a non-metallic inclusion and in JP-A No. 10-121201 there is proposed a high strength spring steel improved in the resistance to delayed fracture by controlling the amount of P segregation in the pre-austenite grain boundary of steel having the structure of martensite. Further, in JP-A No. 2003-306747 is proposed a spring steel improved in the resistance to fatigue by controlling the residual γ, in JP-A No. 2003-213372 is proposed a spring steel improved in the resistance to fatigue by controlling the pre-austenite grain size. In JP-A No. 2003-105485 is disclosed a high strength spring steel improved in the resistance to hydrogen-induced fatigue fracture by making the steel structure into a lamellar structure of martensite and ferrite.

DISCLOSURE OF THE INVENTION

Problem to be Solved by the Invention

The spring steel used as the material of critical safety parts whose breakage leads to a serious accident, such as valve spring and suspension spring, is required to have a satisfactory and stable brittle fracture resistance even when it is made high in strength. However, the conventional spring steel has not yet attained a satisfactory resistance to fracture when it is made high in strength to 1900 MPa or more in terms of tensile strength.

The present invention has been accomplished in view of the above-mentioned circumstances and it is an object of the invention to provide a spring steel having a high strength of 1900 MPa or more and superior in the brittle fracture resistance. In many cases, the structure of martensite is applied as a metal structure of a high strength steel. However, when the steel is strengthened using the martensite structure, the fracture resistance varies greatly depending on working conditions. Particularly, when hydrogen is concerned in the steel or the steel has a notch, a brittle fracture along a pre-austenite grain boundary is apt to occur, which may result in sudden deterioration of the fracture resistance. In the present invention, components and structure of a spring steel are specified from the viewpoint that preventing the brittle fracture typified by the pre-austenite grain boundary fracture is important for ensuring a stable resistance to fracture independently of working conditions while utilizing the martensite structure to attain a high strength. In this way the present invention has been completed.

The spring steel according to the present invention comprises the following chemical components in mass %, C: 0.4-0.6°, Si: 1.4-3.0%, Mn: 0.1-1.0%, Cr: 0.2-2.5%, P: 0.025% or less, S: 0.025% or less, N: 0.006% or less, Al: 0.1% or less, and O: 0.0030% or less, with the remainder being Fe and inevitable impurities, wherein the amount of solute C is 0.15% or less, the amount of Cr contained as a Cr-containing precipitate is 0.10% or less, a TS value (please note: TS does not mean tensile stress, the same hereinafter) represented by the following equation is 24.8% or more, and the pre-austenite grain diameter is 10 μm or smaller: TS=28.5*[C]+4.9*[Si]+0.5*[Mn]+2.5*[Cr]+1.7*[V]+3.7*[Mo] where [X] stands for mass % of element X.

The spring steel according to the present invention may further comprise, as chemical components, one or more elements selected from group A (Mg: 100 ppm or less, Ca: 100 ppm or less, REM: 1.5 ppm or less), group B (B: 100 ppm or less, Mo: 1.0% or less), group C (Ni: 1.0% or less, Cu: 1.0% or less), and group D (V: 0.3% or less, Ti: 0.1% or less, Nb: 0.1% or less, Zr: 0.1% or less).

The method for manufacturing the spring steel according to the present invention comprises the steps of subjecting a steel having the above chemical components to a plastic working of 0.10 or more in true strain, thereafter subjecting the steel to a quenching treatment involving heating the steel to a temperature T1 of 850° to 1100° C. at an average heating rate at 200° C. or higher of 20 K/s or more and then cooling the steel to a temperature of 200° or lower at an average cooling rate of 30 K/s or more, and subsequently subjecting the steel to a tempering treatment involving heating the steel to a temperature of T2° C. or higher determined by the following equation at an average heating rate at 300° or higher of 20 K/s or more and then cooling the steel to a temperature of 300° C. or lower at a residence time t1 at 300° C. or higher of 240 sec. or less: T2=8*[Si]+47*[Mn]+21*[Cr]+140*[V]+169*[Mo]+385 where [X] stands for mass % of element X.

The spring steel according to the present invention has a tensile strength of 1900 MPa or more and nevertheless has a stable resistance to fracture independently of the working environment, so is suitable as the material of a critical safety part and can contribute greatly to the reduction of the environmental load by a high strength. Besides, the manufacturing method according to the present invention can easily manufacture the aforesaid high strength steel superior in the resistance to fracture and is thus superior in productivity.

BEST MODE FOR CARRYING OUT THE INVENTION

Figure 1:
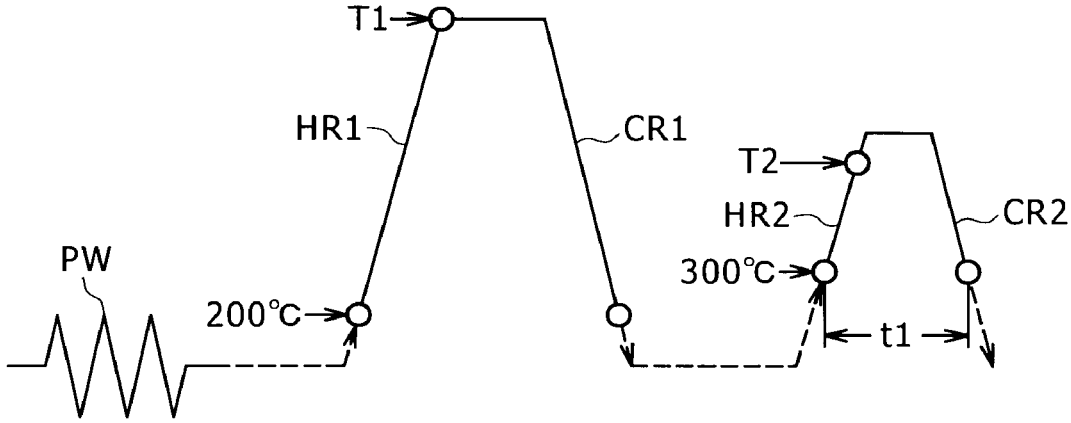
FIG. 1 is a heat treatment diagram showing a process for manufacturing spring steel according to the present invention.

A description will first be given about chemical components of the spring steel according to the present invention and the reason why their contents are limited to the following ranges. All of the units in the following description are mass %.

C: 0.4-0.6%

Carbon (C) is an element which exerts an influence on the strength of a steel material. The larger the amount of C, the higher the strength obtained. If the content of C is less than 0.4%, the high strength of 1900 MPa or more intended in the present invention will not be obtained. On the other hand, if the content of C exceeds 0.6%, the amount of retained austenite after quenching and tempering will increase and there will occur variations in characteristics. In the case of a suspension spring, corrosion resistance will be deteriorated if the content of C is high. In view of these points, in the present invention, a lower limit of the C content is set at 0.4% and an upper limit thereof 0.6%.

Si: 1.4-3.0%

Silicon (Si) is an element effective for improving sag resistance required of springs. An Si content of 1.4% or more is needed for attaining a sag resistance necessary for the strength of the spring intended in the present invention. Preferably, the Si content is 1.7% or more, more preferably 1.9% or more. However, since Si accelerates decarbonization, an excessive Si content rather results in deterioration of fatigue resistance due to decarbonization of the steel surface. Accordingly, an upper limit of the Si content is set at 3.0%, preferably 2.8%, more preferably 2.5%.

Mn: 0.1-1.0%

Manganese (Mn) is a useful element which is utilized as a deoxidizing element and which forms harmless MnS together with S as a harmful element in the steel. This effect will not be exhibited to a satisfactory extent if the Mn content is less than 0.1%. However, an excessive Mn content permits easy formation of segregation sites in the course of solidifying in steel manufacture, with consequent variations in the material. Accordingly, a lower limit of the Mn content is set at 0.1%, preferably 0.15%, more preferably 0.2%, while an upper limit thereof is set at 1.0%, preferably 0.8%, more preferably 0.4%.

Cr: 0.2-2.5%

Chromium (Cr) is effective for ensuring strength after tempering; besides, it improves corrosion resistance and is therefore an important element for a suspension spring which requires a high corrosion resistance. However, an excessive Cr content will result in formation of a hard Cr-rich carbide and deterioration of fracture resistance. Accordingly, in order to obtain the effect of corrosion resistance, a lower limit of the Cr content is set at 0.2%, preferably 0.4%, more preferably 0.7%, while in consideration of deterioration of fracture resistance, an upper limit thereof is set at 2.5%, preferably 2.3%, more preferably 2.0%.

P: 0.025% or Less

Phosphorus (P) is a harmful element which deteriorates the fracture resistance of the steel and therefore it is important to decrease the content of P. For this reason, an upper limit of the P content is set at 0.025%. Preferably, the P content is 0.015% or less, more preferably 0.01% or less.

S: 0.025% or Less

Sulfur (S) is also a harmful element which deteriorates the fracture resistance of the steel and therefore it is important to decrease the content of S. For this reason, an upper limit of the S content is set at 0.025%. Preferably, the S content is 0.015% or less, more preferably 0.010% or less.

N: 0.006% or Less

Nitrogen (N), if present as solute nitrogen, deteriorates the fracture resistance of the steel. However, in the case where the steel contains an element which forms a nitride with nitrogen, e.g., Al or Ti, nitrogen may act effectively in refining the structure. In the present invention, for minimizing solute nitrogen, an upper limit of the N content is set at 0.006%. Preferably, the N content is 0.005% or less, more preferably 0.004% or less.

Al: 0.1% or Less

Aluminum (Al) is added mainly as a deoxidizing element. Aluminum forms AlN with N, fixing N and making it harmless. In addition, aluminum contributes to refining the structure. However, aluminum accelerates decarbonization, so in the case of a spring steel containing a large amount of Si, it is not desirable to add a large amount of Al. Moreover, fatigue fracture starts from a coarse Al oxide. Accordingly, in the present invention, the Al content is set at 0.1% or less, preferably 0.07% or less, more preferably 0.05% or less. As to a lower limit thereof, no limitation is made, but for the reason of fixing N, it is preferable to satisfy the relationship of [Al] (mass %)>2×[N] (mass %).

O: 0.0030% or Less

An increase in the amount of oxygen (O) contained in the steel leads to formation of a coarse oxide, from which fracture starts. Therefore, in the present invention, an upper limit of the O content is set at 0.0030%. Preferably, the O content is 0.0020% or less, more preferably 0.0015% or less.

The spring steel according to the present invention comprises the above basic components and the balance Fe and inevitable impurities. In this case, the content of solute C in the steel, the content of Cr (compound type Cr content) contained as a Cr-containing precipitate, and a TS value represented by an equation which will be referred to later, are defined as follows.

Solute C Content: 0.15% or Less

Martensite of carbon steel as quenched is in a state of a supersaturated solid solution of C. By tempering, C precipitates as a carbide and the amount of solid solution decreases. If tempering is performed to a satisfactory extent, the composition approaches a thermodynamic equilibrium composition. However, as the amount of solute C decreases as a result of tempering, the strength of martensite becomes lower. A high strength can be obtained by performing the tempering treatment at a low temperature for a short period of time. In this case, however, solute C cannot precipitate to a complete extent and is apt to remain in the steel in a soluted state even after tempering. If alloying elements are added for ensuring a required strength after tempering, the precipitation and growth of a carbide are suppressed, so that it becomes easier for solute C to remain. A high strength is obtained if solute C remains, but according to the finding made by the present inventors, brittle fracture becomes very easy to occur if solute C is present in excess of 0.15%. Therefore, in the present invention, the solute C content is controlled to 0.15% or less. Preferably, the solute C content is 0.12% or less, more preferably 0.07% or less.

Compound Type Cr Content: 0.10% or Less

Supersaturatedly soluted C precipitates mainly as cementite by tempering. In the case where an alloying element is added, a special carbide other than cementite may be precipitated or the alloying element may be (solid-)soluted in cementite, whereby the required strength after tempering is ensured. Particularly, with Cr added, the Cr (solid-)solutes in cementite and causes the hardness of cementite itself to increase. As the case may be, a hard Cr carbide is formed. This phenomenon is effective for ensuring the required strength. On the other hand, as to fracture resistance, since the carbide becomes hard and cementite and Cr carbide are relatively coarse precipitates, there occurs stress concentration in the precipitates and the fracture resistance is rather deteriorated. For improving the fracture resistance it is necessary to suppress the formation of the Cr-containing precipitate in tempering. According to an experiment conducted by the present inventors it has turned out that, by controlling the content of Cr (compound type Cr content) contained in the Cr-containing precipitate in the steel to 0.10% or less, the formation of the Cr-containing precipitate is suppressed and the fracture resistance is improved. Therefore, an upper limit of the compound type Cr content is set at 0.10%, preferably 0.08%, more preferably 0.06%.

TS Value: 24.8% or More $$TS=28.5*[C]+4.9*[Si]+0.5*[Mn]+2.5*[Cr]+1.7*[V]+3.7*[Mo]$$

TS value is a parameter which defines the strength of the steel after tempering and is calculated by the above TS equation on the basis of the amounts of the elements C, Si, Mn, Cr, V and Mo used which exert a great influence on the strength after tempering. If the TS value is smaller than 24.8%, it is difficult to stably ensure the strength of 1900 MPa or more which is required of the high strength spring steel. Therefore, a lower limit of TS value is set at 24.8%, preferably 26.3%, more preferably 27.8%. The magnifications (coefficients) of the amounts of elements in the TS equation have been calculated on the basis of working example data which will be referred to later.

The components of the high strength spring steel according to the present invention are as described above, but there may be added one or more elements (characteristic improving elements) selected from group A (Mg, Ca, REM) having an oxide softening action, group B (B, Mo) effective for improving hardenability, group C (Ni, Cu) effective for inhibiting the decarbonization of surface layer and improving corrosion resistance, and group D (V, Ti, Nb, Zr) forming carbonitrides and effective for refining the structure.

The amounts of the above characteristic improving elements to be added and the reason for specifying the amounts will be described in detail below.

Mg: 100 ppm or Less

Magnesium (Mg) exhibits an oxide softening effect.

Preferably, Mg is added 0.1 ppm or more. An excess amount of Mg causes a change in oxide properties and therefore an upper limit of the Mg content is set at 100 ppm, preferably 50 ppm, more preferably 40 ppm.

Ca: 100 ppm or Less

Calcium (Ca) also exhibits an oxide softening effect and forms a sulfide easily, making sulfur (S) harmless. For attaining this action effectively it is preferable that calcium be added in an amount of 0.1 ppm or more. However, an excess amount of Ca causes a change in oxide properties and therefore an upper limit of the Ca content is set at 100 ppm, preferably 50 ppm, more preferably 40 ppm.

REM: 1.5 ppm or Less

A rare earth element (REM) also exhibits an oxide softening effect and is preferably added in an amount of 0.1 ppm or more. However, an excess amount thereof causes a change in oxide properties and therefore an upper limit of the REM content is set at 1.5 ppm, preferably 0.5 ppm.

B: 100 ppm or Less

Boron (B) exhibits a hardenability improving action and is therefore effective for obtaining the structure of martensite from fine austenite. Further, boron fixes N as BN and thereby makes it harmless. For attaining this action effectively it is preferable to add B in an amount of 1 ppm or more. However, an excess amount of B forms borocarbides and therefore an upper limit of the B content is set at 50 ppm, preferably 15 ppm.

Mo: 1.0% or Less

Molybdenum (Mo) also functions to improve hardenability and makes it easier to obtain the structure of martensite from fine austenite. Besides, Mo is an element effective for ensuring a high strength after tempering. For allowing these actions to be exhibited effectively it is preferable to add Mo in an amount of 0.1% or more. For attaining a satisfactory effect it is preferably to add Mo in an amount of 0.15% or more, more preferably 0.2% or more. However, if Mo is added in an excess amount, the strength of rolled steel increases and it becomes difficult to perform peeling and wire drawing before quenching. Therefore, an upper limit of the Mo content is set at 1.0%, preferably 0.7%, more preferably 0.5%.

Ni: 1.0% or Less

Nickel (Ni) is effective for inhibiting the decarbonization of surface layer and improving corrosion resistance. For attaining this action effectively it is preferable to add Ni in an amount of 0.2% or more, more preferably 0.25% or more. However, if Ni is added in an excess amount, the amount of retained austenite after quenching increases and there occur variations in characteristics. Therefore, an upper limit of the Ni content is set at 1.0%, and taking the cost of material into account, it is preferably 0.7%, more preferably 0.5%.

Cu: 1.0% or Less

Copper (Cu), like Ni, is also effective for inhibiting the decarbonization of surface layer and improving corrosion resistance. Further, Cu forms a sulfide and thereby makes S harmless. Attaining these actions effectively it is preferable to add Cu in an amount of 0.1% or more. For obtaining a satisfactory effect it is preferable to add Cu in an amount of 0.15% or more, more preferably 0.2% or more. When the amount of Cu exceeds 0.5%, it is preferable that Ni be also added in an amount equal to or larger than the amount of Cu added. However, if Cu is added in an excess amount, cracking may occur in hot working. Therefore, an upper limit of the Cu content is set at 1.0%, and taking the cost of material into account, it is preferably 0.7%, more preferably 0.5%.

V: 0.3% or Less

Vanadium (V) forms carbonitrides, thereby contributing to refining the structure and is also effective for ensuring a high strength after tempering. For attaining this action effectively it is preferable to add V in an amount of 0.02% or more. For attaining a satisfactory effect it is preferable to add V in an amount of 0.03% or more, more preferably 0.05% or more. However, if V is added to excess, the strength of rolled material increases, making it difficult to perform peeling and wire drawing before quenching. Therefore, an upper limit of the V content is set at 0.3%, preferably 0.25%, more preferably 0.2%.

Ti: 0.1% or Less

Titanium (Ti) forms carbonitrides and thereby contributes to refining the structure. It also forms nitrides and sulfides, thereby making N and S harmless. For attaining these actions effectively it is preferable to add Ti in an amount of preferably 0.01% or more, more preferably 0.02% or more, still more preferably 0.03% or more, so as to satisfy the relationship of $[Ti]>3.5\times[N]$. However, if Ti is added to excess, there is a fear that a coarse TiN may be formed, causing deterioration of toughness and ductility. Therefore, an upper limit of the Ti content is set at 0.1%, preferably 0.08%, more preferably 0.06%.

Nb: 0.1% or Less

Niobium (Nb) also forms carbonitrides and thereby contributes mainly to refining the structure. For attaining this action effectively it is preferable to add Nb in an amount of 0.002% or more. For attaining a satisfactory effect it is preferable to add Nb in an amount of 0.003% or more, more preferably 0.005% or more. However, an excessive amount of Nb causes formation of coarse carbonitrides, with consequent deterioration of toughness and ductility of the steel. Therefore, an upper limit of the Nb content is set at 0.1%, preferably 0.08%, more preferably 0.06%.

Zr: 0.1% or Less

Zirconium (Zr) forms carbonitrides and thereby contributes to refining the structure. For attaining this action effectively it is preferable add Zr in an amount of 0.003% or more, more preferably 0.005% or more. However, an excess amount of Zr causes formation of coarse carbonitrides, with consequent deterioration of toughness and ductility of the steel. Therefore, an upper limit of the Zr content is set at 0.1%, preferably 0.08%, more preferably 0.06%.

Chemical components of the steel according to the present invention are as described above. Further, in the structure of the steel, the pre-austenite grain diameter is set at 10 μm or less. As to characteristics of martensite steel, the finer the pre-austenite grain diameter, the better. Particularly, refining the structure is every effective for improving the fracture resistance. For improving the fracture resistance of the spring steel having a strength of 1900 MPa or more according to the present invention it is necessary that the pre-austenite grain diameter be controlled to 10 μm or less, preferably 8 μm or less, more preferably 6 μm or less. The spring steel according to the present invention is constituted by the structure of tempered martensite, but may contain retained austenite partially in a range of 5% or less in terms of percent by volume.

The spring steel according to the present invention, which has the above components and structure, is 1900 MPa or more in tensile strength and nevertheless is superior in fracture resistance. As to the tensile strength, it can be adjusted preferably to 2000 MPa or more, more preferably 2100 MPa or more, by adjusting the components and structure within the scope of the present invention. Thus, the spring concerned can be made higher in strength.

The following description is now provided about the high strength spring steel manufacturing method according to the present invention.

The manufacturing method according to the present invention comprises the steps of producing a steel having the above chemical components by a conventional method, subsequently as shown in FIG. 1, (1) a plastic working (PW) step of subjecting the steel to a plastic working of 0.10 or more in true strain, (2) after the subjection of the plastic working (PW) to the steel, a subsequent quenching step of heating the steel to a temperature T1 of 850° to 1100° C. at an average heating rate (HR1) at 200° C. or higher of 20 K/s or more, and (3) a subsequent tempering step of heating the steel to a lower limit tempering temperature T2 (° C.) or higher determined by the following equation at an average heating rate (HR2) at 300° C. or higher of 20 K/s or more and then cooling the steel to 300° C. or lower at a residence time t1 at 300° C. or higher of 240 sec. or shorter: T2=8*[Si]+47*[Mn]+21*[Cr]+140*[V]+169*[Mo]+385, where [X] stands for mass % of element X.

Thus, in the above plastic working step the steel is subjected, before quenching, to a plastic working (PW) of 0.1 or more in true strain. This is for the following reason. If the steel is subjected to a predetermined working before quenching, uniforming of nucleation of austenite is accelerated during heating in quenching. If the true strain is less than 0.10, the amount of the plastic working is insufficient and it is impossible to make nucleation uniform, thus making it impossible to obtain an austenite grain diameter of 10 μm or less. Therefore, the true strain to be imparted to the steel is set at 0.1 or more, preferably 0.15 or more, more preferably 0.20 or more.

In the above quenching step, the heating in quenching is performed at a temperature T1 of 850° to 1100° C. at an average heating rate HR1 at 200° C. or higher of 20K/s. This is for the following reason. By increasing the heating rate it is intended to prevent a decrease of the introduced strain in the plastic working step before quenching and thereby make nucleation uniform. In this case, if the average heating rate HR1 is lower than 20 K/s, there will occur recovery of the strain introduced in the plastic working step, making it impossible to attain a uniform nucleation of austenite. Therefore, the average heating rate HR1 is set at 20 K/s or more, preferably 40 K/s or more, more preferably 70 K/s or more. By setting the heating temperature T1 at 850° to 1100° C. it is possible to prevent the dissolution of carbonitrides which inhibits the growth of crystal grains and hence possible to obtain fine austenite grains. The reason why cooling is performed to 200° C. or lower at an average cooling rate CR1 of 30 K/s or more after heating is that it is intended to obtain the structure of martensite. The austenite grains before cooling are fine, so if the average cooling rate is lower than 30 K/s, it is difficult to obtain a complete quenched structure. Therefore, the average cooling rate CR1 is set at 30 K/s or more, preferably 50 K/s or more, more preferably 70 K/s or more.

In the tempering step the amount of solute C and that of compound type Cr are controlled. For allowing solute C to precipitate as a carbide and thereby decreasing the amount of solute C, it is necessary to adopt tempering conditions taking the influence of an alloying component into account. By controlling the lower limit of the tempering temperature to the temperature calculated by the foregoing equation T2 or higher it is possible to decrease the amount of solute C to 0.15% or less. The lower limit of the tempering temperature (heating temperature) is preferably T2+15° C., more preferably T2+30° C., still more preferably T2+45° C. The magnification (coefficient) of the amount of element in the T2 equation has been calculated on the basis of working example data to be described later.

The amount of compound type Cr is also controlled by tempering conditions. (Solid-)soluting of Cr into cementite and precipitation of Cr carbides occur at relatively high temperatures. In the present invention, when heating is performed in the tempering step, the average heating rate HR2 at 300° C. or higher is set at 20 K/s or more to suppress the amount of compound type Cr in the course of heating up to T2. Preferably, the average heating rate is set at 40 K/s or more, more preferably 70 K/s or more. After heating to a temperature of T2 or higher and retention for an appropriate time (usually in the range from 0 sec. or more to less than 240 sec.), cooling is conducted. At this time, a retention time t1 at 300° or higher is set at 240 sec. or less to suppress the increase in the amount of compound type Cr in the course from retention at the tempering temperature to cooling. By thus controlling the retention time in the temperature region of 300° C. or higher wherein the amount of compound type Cr is very likely to increase, it is possible to control the amount of compound type Cr to 0.1% of less. The time t1 is set preferably at 90 sec. or less, more preferably 20 sec. or less.

The present invention will be described below more concretely by working examples, but the invention should not be interpreted limitedly by the following examples.

EXAMPLES

Steels shown in Tables 1 and 2 below were melted in vacuum, followed by hot forging and hot rolling by conventional methods, to afford billets of 16 mm in diameter. The billets were then subjected to wire drawing, then quenching and tempering under the conditions shown in Tables 3 to 6. In the quenching and tempering treatments, a general-purpose electric furnace, a salt bath and a high-frequency heating furnace were used, thermocouples were attached to surfaces of the billets to measure the temperature and heat treatment conditions were controlled. The value of "REM" in Tables 1 and 2 means the total amount of La, Ce, Pr, and Nd. The retention time at the tempering temperature was set in the range of 0 to 3000 sec. (0 sec. or more to less than 240 sec. as to those whose t1 values satisfy the condition defined in the invention).

The steels after tempering thus manufactured were checked for structure by determining the pre-austenite grain diameter in the following manner. A steel sample for observation was cut so that a cross section thereof became an observation surface. The sample was then buried into resin, followed by polishing, then the observation surface of etched using an etching solution containing picric acid as a main component, allowing pre-austenite grain boundaries to appear. Observation was made at a magnification of 200× to 1000× using an optical microscope and the pre-austenite grain size was determined by the comparison method. The determination of the grain size was performed at four visual fields or more and a mean value was obtained. From the grain size thus obtained there was calculated an average grain diameter using a conversion expression described in a literature (Umemoto, "Grain Size Number and Grain Diameter," Fueram, 2 (1997), 29). As to steels wherein pre-austenite grain boundaries are difficult to appear before tempering, they were subjected to heat treatment at 500° C. for 2 to 12 hours in order to facilitate development of grain boundaries and were then observed.

The amount of solute C in each steel after tempering was calculated from X-ray diffraction peaks in the following manner using the Rietveld Method. Evaluation samples were each cut so that a cross section or a central longitudinal section of each steel wire after temperature became an evaluation surface, then polished and subjected to X-ray diffraction. For evaluating the amount of solute C, at least two samples were prepared for each steel, then the above measurement was performed and an average value was determined.

The amount of compound type Cr in each steel after tempering was determined in the following manner using the electrolytic extraction method. From each steel after tempering there was fabricated a columnar sample having a diameter of 8 mm and a length of 20 mm by a wet cutting work and cutting of the steel surface. The sample was electrolyzed at 100 mA for 5 hours in an electrolytic solution (a 10% AA-based electrolytic solution) to dissolve the metal Fe in the base phase electrically and a compound in the steel was recovered as a residue from the electrolyte. As a filter for recovering the residue there was used a membrane filter having a mesh diameter of 0.1 μm, a product of Advantec Toyo Kaisha Ltd. The amount of Cr (wCr[g]) contained in the compound thus recovered was measured and, on the basis of a change in weight, ΔW [g] of each sample before and after the electric dissolving, the proportion in the steel, Wp(Cr), of the amount of Cr which forms the compound was calculated in accordance with the following equation: $Wp(Cr)=wCr/\Delta W\times 100$ (mass %). As to the evaluation of inclusion, at least three samples were fabricated for each steel, then the above measurement was performed and a mean value was determined. The results obtained are also shown in Tables 3 to 6.

Further, a tensile test and an anti-hydrogen embrittlement test were conducted using the steel samples. A round bar tensile test piece was fabricated from each steel after tempering and was subjected to machining. Using the thus-machined test piece and a universal testing machine, the tensile test was conducted at a crosshead speed of 10 mm/min and a tensile strength was measured and used as a strength evaluation index.

Figure 2A:
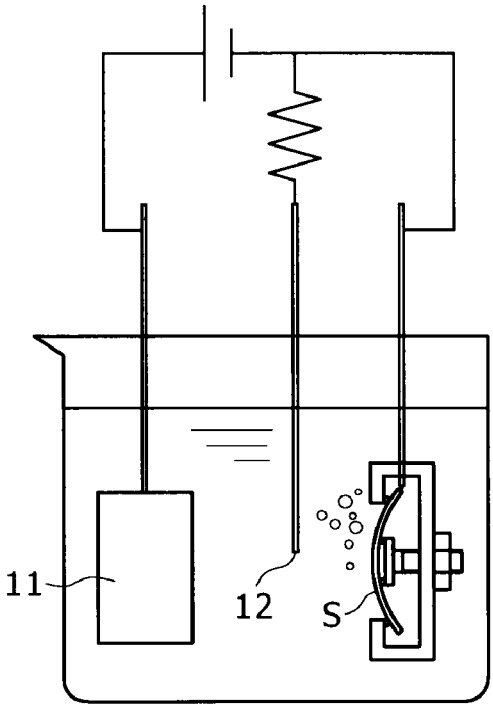
FIG. 2 is an explanatory diagram showing in what manner a four-point being test is to be performed, in which (A) is an entire diagram and (B) is an enlarged diagram of a test piece.
Figure 2B:
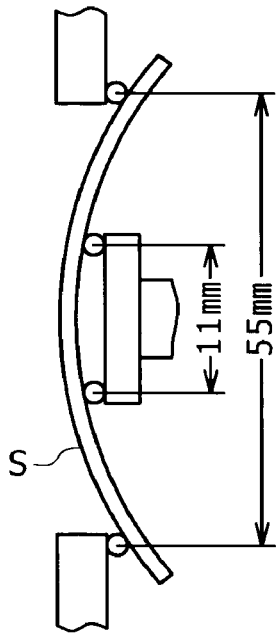

In the anti-hydrogen embrittlement test, a flat plate test piece (65 mm long by 10 mm wide by 1.5 mm thick) was fabricated from each steel after tempering and a cathode charge four-point bending test was conducted using the test piece. In the cathode charge four-point bending test, as shown in FIG. 2, a test piece S loaded with a bending stress (1400 MPa) is cathode-charged at a potential of −700 mV in an acid solution (0.5 mol/l $H_2SO_4$+0.01 mol/l KSCN) and time required from the start of charging until fracture is measured. This fracture life was used as an evaluation index of resistance to hydrogen embrittlement. If the fracture life is 1000 sec. or more, resistance is ensured to hydrogen embrittlement in the actual environment and therefore the resistance to hydrogen embrittlement was evaluated on the basis of the fracture life of 1000 sec. In FIG. 2, the numeral 11 denotes a platinum electrode and numeral 12 denotes a standard electrode (SC).

Further, for evaluating the brittle fracture resistance, each fractured sample in the cathode charge four-point test was checked for the form of fracture. After the end of the cathode charge four-point bending test, each such fractured sample was stored and the fractured surface was observed at a magnification of 500× to 2000× using a scanning electron microscope (SEM). On the fractured surface photograph obtained, the ratio of pre-austenite grain boundary fracture as a brittle fracture was measured as a percent brittle fracture and was used as an index of brittle fracture resistance. The lower the ratio of pre-austenite grain boundary fracture, i.e., the lower the percent brittle fracture, the more excellent the brittle fracture resistance. In evaluating the percent brittle fracture, from fractured surface observing photographs of at least five visual fields, the percent area on the photographs of pre-austenite grain boundary fracture portions was measured using the image analyzing software ImagePro ver. 4). The percent brittle fracture was evaluated on the basis of 85% because the percent brittle fracture is 85% in the case of the practical suspension spring steel SUP12 of the tensile strength 1750 MPa class.

The results of these tests are also shown in Tables 3 to 6. Further, the relation between tensile strength and fracture life is summarized in the graph of FIG. 3 and the relation between tensile strength and the percent brittle fracture is summarized in the graph of FIG. 4.

Figure 3:
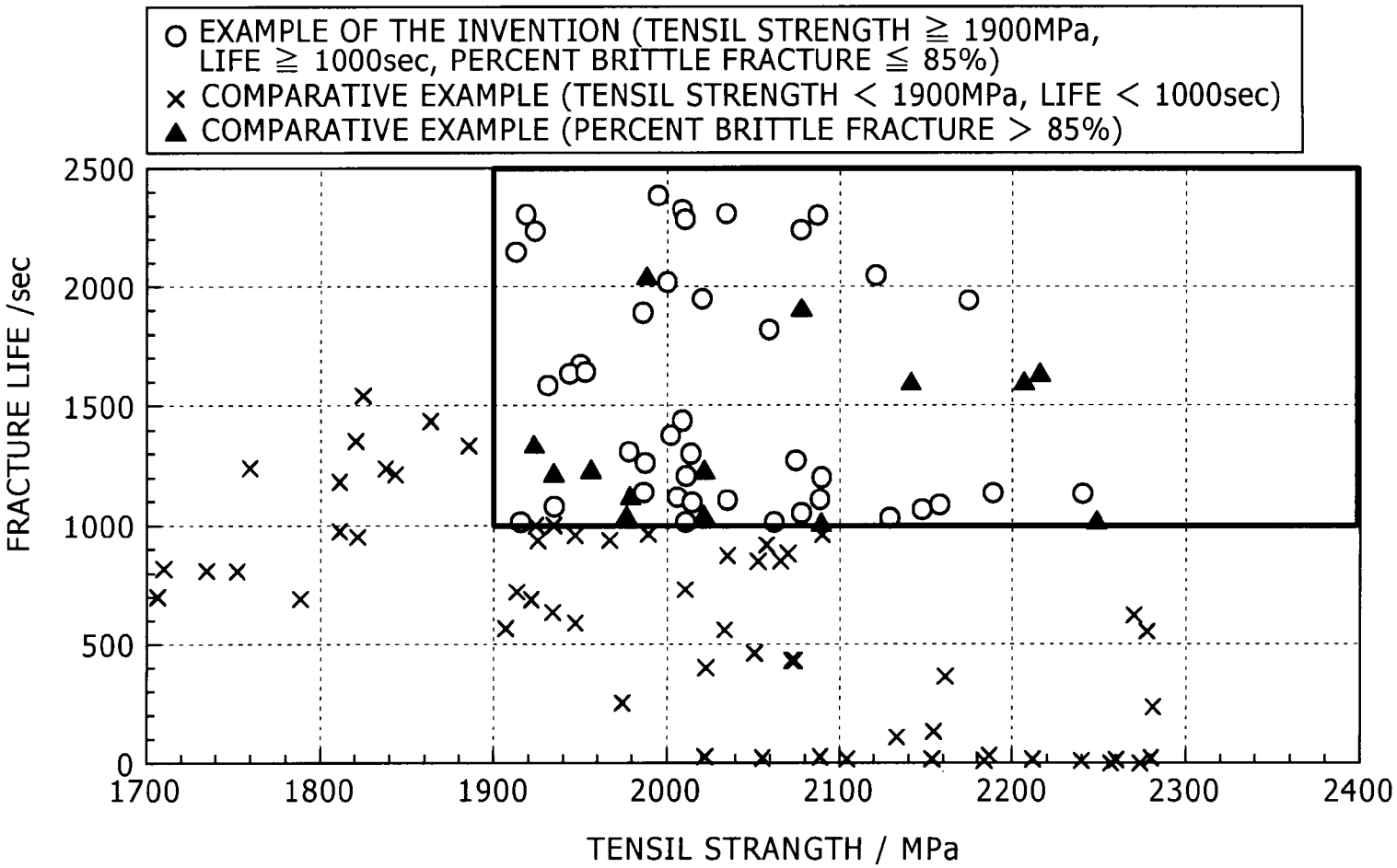
FIG. 3 is a graph showing a relation between tensile strength and fracture life in examples.
Figure 4:
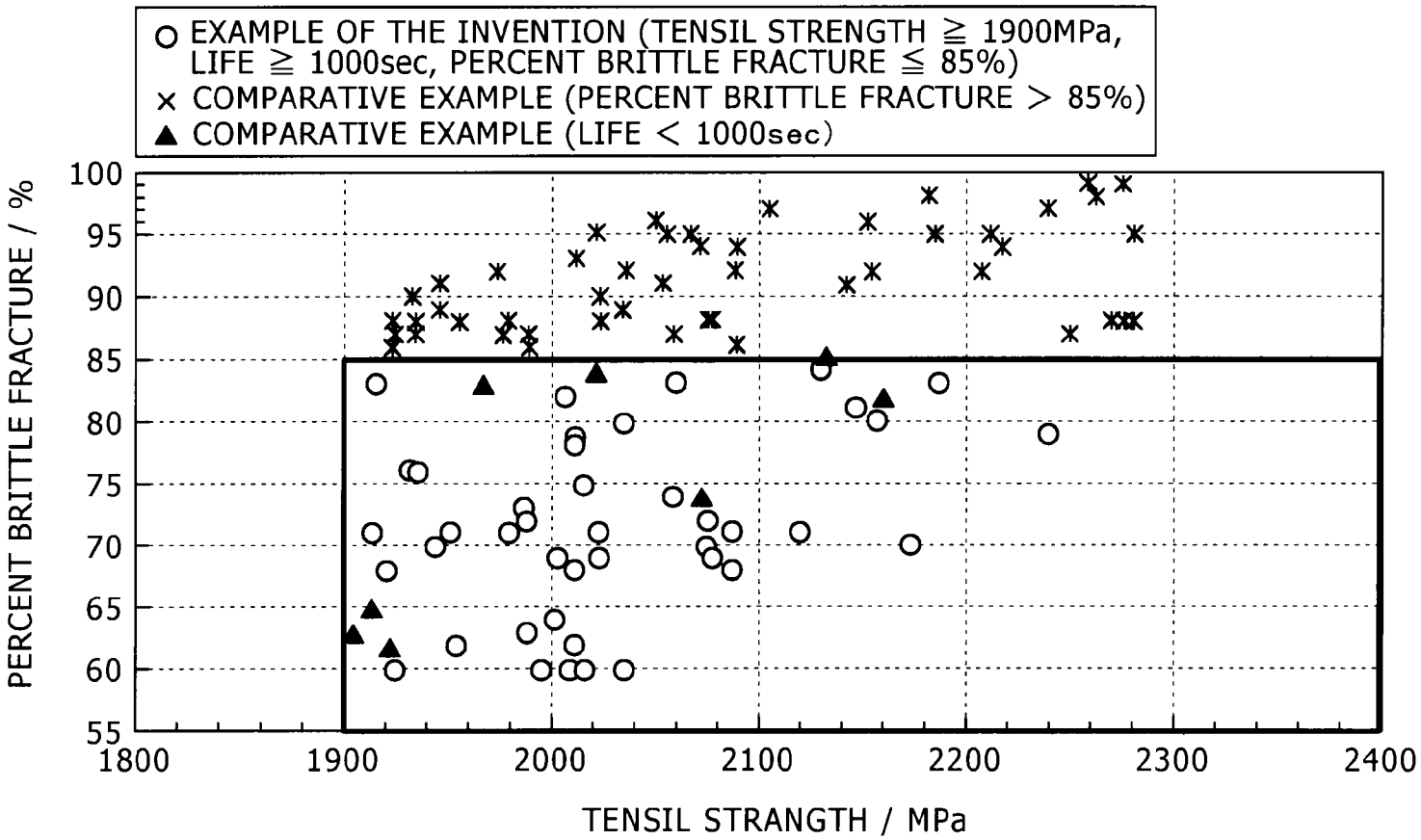
FIG. 4 is a graph showing a relation between tensile strength and percent brittle fracture in examples.

From Tables 3 to 6 and FIGS. 3 and 4 it is seen that the examples of the present invention (the circles in FIGS. 3 and 4 and sample numbers free of the symbol * in the tables) which satisfies all of the conditions on components and manufacturing conditions defined in the present invention possess a high strength of 1900 MPa or more and nevertheless possess a high resistance to hydrogen embrittlement of 1000 sec. or more in terms of fracture life and that the percent brittle fracture is 85% or less and thus the brittle fracture is suppressed satisfactorily and stably. On the other hand, it is seen that comparative examples not satisfying the conditions defined in the present invention cannot possess a tensile strength of 1900 MPa or more, as well as such resistance to hydrogen embrittlement and brittle fracture resistance as satisfy the respective reference values, and that even if a high strength is attained, a problem exists in their application to a member for which a stable fracture resistance is required, e.g., application as the material of a suspension spring.

TABLE 1

| Steel | Components (mass %) | | | | | | | | | | |
|---|---|---|---|---|---|---|---|---|---|---|---|
| No. | C | Si | Mn | Cr | P | S | N | Al | O | Ni | Cu |
| * A1 | 0.30 | 3.33 | 2.79 | 2.40 | 0.015 | 0.026 | 0.0048 | 0.0320 | 0.0019 | 0.28 | 0.35 |
| * A2 | 0.33 | 2.55 | 0.74 | 0.25 | 0.007 | 0.007 | 0.0050 | 0.0311 | 0.0010 | | |
| * A3 | 0.36 | 2.51 | 2.48 | 2.52 | 0.006 | 0.008 | 0.0064 | 0.0310 | 0.0011 | 0.78 | 0.77 |
| * A4 | 0.37 | 2.48 | 2.51 | 2.47 | 0.010 | 0.011 | 0.0050 | 0.0330 | 0.0013 | 0.82 | 0.89 |
| * A5 | 0.39 | 1.61 | 0.22 | 1.09 | 0.012 | 0.010 | 0.0037 | 0.0309 | 0.0010 | 0.23 | 0.15 |
| * A6 | 0.40 | 1.80 | 0.27 | 1.81 | 0.006 | 0.005 | 0.0041 | 0.3250 | 0.0013 | 0.71 | 0.82 |
| * A7 | 0.41 | 1.75 | 0.18 | 1.05 | 0.008 | 0.008 | 0.0041 | 0.0300 | 0.0019 | 0.53 | 0.22 |
| * A8 | 0.41 | 2.23 | 0.22 | 0.65 | 0.007 | 0.006 | 0.0037 | 0.0320 | 0.0012 | 0.50 | 0.18 |
| A9 | 0.41 | 1.92 | 0.18 | 1.12 | 0.007 | 0.006 | 0.0032 | 0.0009 | 0.0008 | 0.30 | 0.15 |
| A10 | 0.41 | 2.02 | 0.18 | 1.55 | 0.005 | 0.005 | 0.0030 | 0.0010 | 0.0009 | 0.28 | 0.16 |
| * A11 | 0.41 | 1.80 | 0.91 | 2.49 | 0.009 | 0.008 | 0.0052 | 0.0770 | 0.0012 | 0.55 | 0.20 |
| A12 | 0.42 | 2.18 | 0.18 | 1.54 | 0.006 | 0.007 | 0.0027 | 0.0006 | 0.0007 | 0.40 | 0.42 |
| A13 | 0.42 | 1.81 | 0.21 | 2.48 | 0.011 | 0.010 | 0.0030 | 0.0310 | 0.0010 | 0.50 | 0.21 |
| * A14 | 0.42 | 1.85 | 2.40 | 1.02 | 0.009 | 0.012 | 0.0040 | 0.0780 | 0.0017 | | |
| A15 | 0.42 | 1.83 | 0.18 | 1.02 | 0.010 | 0.008 | 0.0038 | 0.0330 | 0.0013 | 0.49 | 0.18 |
| A16 | 0.44 | 1.95 | 0.15 | 1.18 | 0.018 | 0.017 | 0.0035 | 0.0270 | 0.0010 | 0.39 | 0.40 |
| A17 | 0.44 | 1.92 | 0.18 | 1.00 | 0.008 | 0.007 | 0.0039 | 0.0310 | 0.0012 | 0.61 | 0.20 |
| * A18 | 0.46 | 2.00 | 0.78 | 0.21 | 0.017 | 0.018 | 0.0042 | 0.0280 | 0.0011 | 0.31 | 0.27 |
| * A19 | 0.47 | 2.19 | 0.18 | 0.20 | 0.012 | 0.011 | 0.0035 | 0.0300 | 0.0010 | 0.22 | 0.32 |
| A20 | 0.48 | 1.98 | 0.77 | 0.22 | 0.015 | 0.017 | 0.0033 | 0.0320 | 0.0014 | 0.28 | 0.32 |
| A21 | 0.49 | 2.01 | 0.62 | 1.21 | 0.021 | 0.020 | 0.0028 | 0.0300 | 0.0011 | 0.02 | 0.01 |
| * A22 | 0.50 | 2.03 | 0.61 | 3.08 | 0.020 | 0.018 | 0.0031 | 0.0290 | 0.0010 | 0.02 | 0.02 |
| A23 | 0.50 | 2.01 | 0.39 | 1.83 | 0.013 | 0.014 | 0.0032 | 0.0300 | 0.0008 | 0.01 | 0.02 |
| A24 | 0.50 | 2.18 | 0.18 | 1.20 | 0.005 | 0.006 | 0.0028 | 0.0320 | 0.0005 | 0.40 | 0.39 |
| A25 | 0.52 | 2.40 | 0.18 | 1.02 | 0.004 | 0.005 | 0.0030 | 0.0310 | 0.0005 | 0.60 | 0.58 |
| A26 | 0.51 | 2.39 | 0.18 | 1.04 | 0.004 | 0.006 | 0.0032 | 0.0290 | 0.0009 | 0.61 | 0.57 |
| A27 | 0.51 | 2.55 | 0.19 | 1.11 | 0.004 | 0.006 | 0.0031 | 0.0250 | 0.0008 | 0.81 | |
| A28 | 0.51 | 2.87 | 0.19 | 1.52 | 0.005 | 0.007 | 0.0034 | 0.0220 | 0.0010 | 0.87 | 0.83 |
| * A29 | 0.52 | 3.22 | 0.20 | 1.55 | 0.004 | 0.070 | 0.0028 | 0.0210 | 0.0010 | 0.88 | 0.67 |
| * A30 | 0.54 | 1.42 | 0.71 | 0.72 | 0.017 | 0.016 | 0.0038 | 0.0310 | 0.0011 | | |

| Steel | Components (mass %) | | | | | Components (ppm) | | | | TS value |
|---|---|---|---|---|---|---|---|---|---|---|
| No. | Mo | V | Ti | Nb | Zr | Mg | Ca | REM | B | (%) |
| * A1 | | | | 0.050 | 0.051 | | | | 55.0 | 32.26 |
| * A2 | | | | | | | | | | 22.90 |
| * A3 | | 0.247 | 0.081 | | | 0.1 | 1.4 | 0.1 | 3.0 | 30.52 |
| * A4 | | 0.322 | | 0.108 | | 0.4 | 2.6 | 0.2 | 15.0 | 30.67 |
| * A5 | | 0.079 | | | | | | | | 21.97 |
| * A6 | | | 0.082 | 0.011 | | 0.3 | | | | 24.88 |
| * A7 | 0.02 | 0.170 | 0.070 | | | 0.2 | 2.7 | | 1.0 | 23.34 |
| * A8 | 0.01 | 0.151 | 0.021 | | | | | | | 24.64 |
| A9 | 0.48 | 0.150 | | | 0.020 | 10.0 | 15.0 | 0.2 | 2.0 | 26.01 |
| A10 | 0.15 | | 0.051 | 0.005 | 0.022 | 12.0 | 17.0 | 0.3 | 12.0 | 26.10 |
| * A11 | | 0.248 | 0.089 | | | 0.1 | 2.1 | | 1.0 | 27.61 |
| A12 | | | 0.052 | 0.005 | 0.021 | 0.3 | 2.2 | 0.1 | 15.0 | 26.59 |
| A13 | | 0.161 | 0.062 | | | | | | | 27.42 |
| * A14 | | | | | | | | | | 24.79 |
| A15 | 0.32 | 0.175 | 0.071 | | | | 3.4 | | | 25.06 |
| A16 | 0.02 | 0.002 | 0.068 | | | 0.1 | 2.2 | | 1.0 | 25.20 |
| A17 | 0.02 | 0.155 | 0.068 | | | 0.1 | 1.8 | | 1.0 | 24.88 |
| * A18 | 0.01 | 0.156 | 0.072 | | | 0.1 | 1.9 | 0.1 | | 24.13 |
| * A19 | | | 0.021 | | | 0.5 | 5.8 | 0.3 | 3.0 | 24.72 |
| A20 | 0.78 | | 0.048 | | | 0.6 | 3.6 | 0.2 | 1.0 | 27.20 |
| A21 | | 0.080 | 0.051 | | | | | | | 27.29 |
| * A22 | | 0.081 | 0.052 | | | | | | | 32.34 |
| A23 | | 0.079 | 0.048 | | | | | | | 29.00 |
| A24 | | | 0.070 | | | 35.0 | 34.0 | | 23.0 | 28.02 |
| A25 | | | 0.050 | | | 35.0 | 38.0 | | 22.0 | 29.22 |
| A26 | | | 0.050 | | | | | | 1.0 | 28.94 |
| A27 | | | 0.077 | 0.005 | 0.032 | 3.5 | 3.8 | 0.3 | 8.0 | 29.90 |
| A28 | | | 0.081 | 0.011 | | 12.0 | 15.0 | 1.2 | 10.0 | 32.49 |
| * A29 | | | 0.062 | 0.021 | | 11.0 | 15.0 | 0.3 | | 34.57 |
| * A30 | | | | | 0.051 | | | | | 24.50 |

Note:

Steel No. with "*" mark represents a comparative steel, while Sample No. without the said mark represents a steel according to the present invention.

TABLE 2

| Steel No. | Components (mass %) C | Si | Mn | Cr | P | S | N | Al | O | Ni | Cu |
|---|---|---|---|---|---|---|---|---|---|---|---|
| A31 | 0.55 | 1.81 | 0.77 | 0.70 | 0.013 | 0.009 | 0.0041 | 0.0300 | 0.0012 | | 0.03 |
| A32 | 0.57 | 1.41 | 0.76 | 0.70 | 0.016 | 0.016 | 0.0039 | 0.0320 | 0.0014 | 0.02 | 0.03 |
| * A33 | 0.57 | 1.42 | 0.70 | 0.71 | 0.008 | 0.009 | 0.0032 | 0.7180 | 0.0015 | 0.72 | 0.70 |
| * A34 | 0.58 | 1.41 | 0.91 | 0.20 | 0.009 | 0.010 | 0.0035 | 0.0310 | 0.0012 | | |
| * A35 | 0.58 | 0.19 | 0.90 | 0.85 | 0.014 | 0.013 | 0.0066 | 0.5210 | 0.0034 | | |
| * A36 | 0.58 | 0.20 | 2.98 | 2.39 | 0.027 | 0.028 | 0.0071 | 0.0280 | 0.0012 | | |
| * A37 | 0.59 | 1.05 | 1.49 | 1.48 | 0.013 | 0.012 | 0.0034 | 0.0320 | 0.0011 | | |
| * A38 | 0.60 | 2.00 | 0.90 | 0.13 | 0.013 | 0.012 | 0.0051 | 0.0330 | 0.0016 | 1.21 | 1.06 |
| A39 | 0.60 | 2.01 | 0.91 | 2.02 | 0.010 | 0.011 | 0.0030 | 0.0012 | 0.0008 | 0.15 | 0.20 |
| * A40 | 0.61 | 2.19 | 0.88 | 0.21 | 0.013 | 0.011 | 0.0044 | 0.0009 | 0.0005 | | |
| A41 | 0.61 | 2.17 | 0.88 | 0.20 | 0.005 | 0.004 | 0.0030 | 0.0003 | 0.0007 | | |
| * A42 | 0.61 | 2.18 | 0.87 | 0.18 | 0.005 | 0.004 | 0.0022 | 0.0008 | 0.0008 | | |
| A43 | 0.61 | 1.47 | 0.53 | 0.54 | 0.012 | 0.007 | 0.0029 | 0.0270 | 0.0010 | | |
| A44 | 0.63 | 1.62 | 0.51 | 0.72 | 0.008 | 0.008 | 0.0030 | 0.0310 | 0.0011 | | |
| * A45 | 0.63 | 1.20 | 0.77 | 0.18 | 0.004 | 0.005 | 0.0028 | 0.0290 | 0.0010 | | |
| * A46 | 0.68 | 1.78 | 0.79 | 0.48 | 0.010 | 0.011 | 0.0028 | 0.0007 | 0.0008 | | |

| Steel No. | Components (mass %) Mo | V | Ti | Nb | Zr | Components (ppm) Mg | Ca | REM | B | TS value (%) |
|---|---|---|---|---|---|---|---|---|---|---|
| A31 | | | | 0.007 | | 0.1 | 1.2 | 0.1 | | 26.68 |
| A32 | | | 0.020 | | | 0.1 | 1.3 | | 1.0 | 25.28 |
| * A33 | | | 0.021 | | 0.055 | 30.0 | 31.0 | 1.1 | | 25.33 |
| * A34 | | | | 0.007 | | | | | | 24.39 |
| * A35 | | | | | | | 0.7 | | | 20.04 |
| * A36 | 0.68 | | | | | 19.0 | 22.0 | 2.5 | | 27.49 |
| * A37 | 1.06 | 0.103 | | 0.112 | | | | | | 30.50 |
| * A38 | | 0.021 | 0.003 | | | 0.2 | 1.4 | 0.1 | | 27.71 |
| A39 | | | 0.021 | 0.010 | | 0.1 | 1.8 | 0.1 | | 32.45 |
| * A40 | 1.18 | | 0.121 | | | | | | | 33.45 |
| A41 | | | 0.021 | | 0.072 | 0.2 | 2.5 | 0.1 | | 28.96 |
| * A42 | | 0.205 | 0.141 | | 0.110 | | | | | 29.30 |
| A43 | | 0.168 | | | | | | | | 26.49 |
| A44 | | | 0.077 | 0.055 | | | | | | 27.95 |
| * A45 | | | | 0.005 | | 0.1 | 1.5 | 0.1 | 12.0 | 24.67 |
| * A46 | | | | 0.051 | 0.002 | | | | 2.0 | 29.70 |

Note:
Steel No. with "*" mark represents a comparative steel, while Sample No. without the said mark represents a steel according to the present invention.

40

TABLE 3

| Sample No. | Steel No. | Strain in wire drawing | Wire dia. after wire drawing mm | Quenching Heating rate K/sec | T1 ° C. | Cooling rate K/sec | Tempering Heating rate K/sec | Heating temperature ° C. | T2 ° C. | t1 sec | Pre-austenite grain dia. μm | Solute C content % | Compound type Cr content % |
|---|---|---|---|---|---|---|---|---|---|---|---|---|---|
| * A1-1 | * A1 | 0.13 | 15.0 | 25 | 1120 | 40 | 50 | 596 | 593 | 12 | 37.7 | — | — |
| * A2-1 | * A2 | 0.13 | 15.0 | 25 | 1120 | 40 | 50 | 484 | 445 | 236 | 33.5 | — | — |
| * A3-1 | * A3 | 0.13 | 15.0 | 25 | 1040 | 40 | 100 | 619 | 609 | 10 | 12.5 | — | — |
| * A4-1 | * A4 | 0.13 | 15.0 | 25 | 1040 | 40 | 50 | 622 | 620 | 13 | 15.6 | — | — |
| * A5-1 | * A5 | 0.13 | 15.0 | 25 | 1040 | 40 | 50 | 452 | 442 | 235 | 22.3 | — | — |
| * A6-1 | * A6 | 0.17 | 14.7 | 50 | 930 | 60 | 80 | 485 | 450 | 7 | 8.3 | 0.041 | 0.012 |
| * A6-3 | | 0.17 | 14.7 | 50 | 930 | 60 | 10 | 350 | 450 | 3006 | 8.3 | 0.161 | 0.210 |
| * A6-4 | | 0.17 | 14.7 | 50 | 930 | 60 | 10 | 375 | 450 | 3009 | 8.3 | 0.154 | 0.301 |
| * A7-1 | * A7 | 0.17 | 14.7 | 100 | 900 | 100 | 80 | 350 | 457 | 3 | 4.5 | 0.177 | 0.010 |
| * A7-2 | | 0.17 | 14.7 | 100 | 900 | 100 | 80 | 375 | 457 | 4 | 4.5 | 0.168 | 0.012 |
| * A7-3 | | 0.17 | 14.7 | 100 | 900 | 100 | 80 | 400 | 457 | 5 | 4.5 | 0.165 | 0.012 |
| * A7-4 | | 0.17 | 14.7 | 100 | 900 | 100 | 80 | 425 | 457 | 5 | 4.5 | 0.161 | 0.013 |
| * A7-5 | | 0.17 | 14.7 | 100 | 900 | 100 | 80 | 450 | 457 | 6 | 4.5 | 0.154 | 0.013 |
| * A8-1 | * A8 | 0.17 | 14.7 | 70 | 930 | 85 | 50 | 491 | 450 | 9 | 5.0 | — | — |
| * A9-1 | A9 | 0.20 | 14.5 | 70 | 1050 | 85 | 1 | 350 | 534 | 281 | 9.2 | 0.175 | 0.109 |
| * A9-2 | | 0.20 | 14.5 | 70 | 1050 | 85 | 1 | 375 | 534 | 306 | 9.2 | 0.165 | 0.115 |
| A9-3 | | 0.20 | 14.5 | 70 | 1050 | 85 | 50 | 572 | 534 | 11 | 9.2 | 0.028 | 0.038 |
| A10-1 | A10 | 0.20 | 14.5 | 70 | 1050 | 85 | 50 | 501 | 468 | 9 | 8.9 | 0.035 | 0.042 |
| * A11-1 | * A11 | 0.20 | 14.5 | 100 | 1070 | 85 | 100 | 553 | 529 | 8 | 8.9 | 0.031 | 0.081 |
| * A12-1 | A12 | 0.17 | 14.7 | 2 | 930 | 60 | 50 | 482 | 443 | 8 | 12.5 | 0.055 | 0.017 |

TABLE 3-continued

| Sample No. | Steel No. | Strain in wire drawing | Wire dia. after wire drawing mm | Quenching Heating rate K/sec | Quenching T1 ° C. | Quenching Cooling rate K/sec | Tempering Heating rate K/sec | Tempering Heating temperature ° C. | Tempering T2 ° C. | Tempering t1 sec | Pre-austenite grain dia. μm | Solute C content % | Compound type Cr content % |
|---|---|---|---|---|---|---|---|---|---|---|---|---|---|
| A12-2 | | 0.17 | 14.7 | 50 | 930 | 60 | 50 | 480 | 443 | 8 | 7.4 | 0.057 | 0.018 |
| * A13-1 | A13 | 0.17 | 14.7 | 2 | 970 | 60 | 1 | 501 | 484 | 206 | 13.8 | 0.074 | 0.088 |
| A13-2 | | 0.17 | 14.7 | 50 | 970 | 60 | 50 | 501 | 484 | 9 | 8.8 | 0.074 | 0.021 |
| * A14-1 | * A14 | — | 16.0 | 2 | 970 | 60 | 1 | 550 | 534 | 256 | 24.7 | — | — |
| * A14-2 | | — | 16.0 | 50 | 970 | 60 | 50 | 548 | 534 | 11 | 18.9 | — | — |
| A15-1 | A15 | 0.17 | 14.7 | 50 | 930 | 60 | 50 | 512 | 508 | 9 | 7.2 | 0.059 | 0.018 |
| A16-1 | A16 | 0.17 | 14.7 | 50 | 930 | 60 | 50 | 479 | 436 | 8 | 8.1 | 0.061 | 0.016 |
| A17-1 | A17 | 0.17 | 14.7 | 50 | 930 | 60 | 50 | 479 | 455 | 8 | 7.0 | 0.067 | 0.017 |
| * A18-1 | * A18 | 0.27 | 14.0 | 50 | 930 | 60 | 50 | 471 | 466 | 8 | 7.8 | — | — |
| * A19-1 | * A19 | 0.27 | 14.0 | 50 | 930 | 60 | 50 | 421 | 415 | 6 | 8.2 | — | — |
| A20-1 | A20 | 0.17 | 14.7 | 50 | 930 | 60 | 50 | 582 | 573 | 12 | 8.8 | 0.035 | 0.021 |

Note:
Sample No. with "*" represents a comparative sample, while Sample No. without the said mark represents a sample according to the present invention.

TABLE 4

| Sample No. | Steel No. | Strain in wire drawing | Wire dia. after wire drawing mm | Quenching Heating rate K/sec | Quenching T1 ° C. | Quenching Cooling rate K/sec | Tempering Heating rate K/sec | Tempering Heating temperature ° C. | Tempering T2 ° C. | Tempering t1 sec | Pre-austenite grain dia. μm | Solute C content % | Compound type Cr content % |
|---|---|---|---|---|---|---|---|---|---|---|---|---|---|
| * A21-1 | | — | 16.0 | 70 | 925 | 100 | 100 | 462 | 467 | 6 | 13.0 | 0.155 | 0.016 |
| * A21-2 | | — | 16.0 | 70 | 925 | 100 | 100 | 490 | 467 | 7 | 13.0 | 0.082 | 0.018 |
| * A21-3 | | — | 16.0 | 70 | 925 | 100 | 100 | 510 | 467 | 7 | 13.0 | 0.037 | 0.021 |
| * A21-4 | | 0.20 | 14.5 | 70 | 925 | 100 | 100 | 463 | 467 | 6 | 6.2 | 0.156 | 0.017 |
| A21-5 | A21 | 0.20 | 14.5 | 70 | 925 | 100 | 100 | 491 | 467 | 7 | 6.2 | 0.072 | 0.018 |
| A21-6 | | 0.20 | 14.5 | 70 | 925 | 100 | 100 | 508 | 467 | 7 | 6.2 | 0.043 | 0.020 |
| A21-7 | | 0.27 | 14.0 | 70 | 925 | 150 | 100 | 460 | 467 | 6 | 3.0 | 0.153 | 0.015 |
| A21-8 | | 0.27 | 14.0 | 70 | 925 | 150 | 100 | 492 | 467 | 7 | 3.0 | 0.070 | 0.017 |
| A21-9 | | 0.27 | 14.0 | 70 | 925 | 150 | 100 | 509 | 467 | 7 | 3.0 | 0.037 | 0.019 |
| * A22-1 | | 0.17 | 14.7 | 10 | 930 | 60 | 10 | 450 | 506 | 247 | 14.8 | 0.170 | 0.288 |
| * A22-2 | | 0.17 | 14.7 | 70 | 930 | 85 | 10 | 450 | 506 | 247 | 7.6 | 0.168 | 0.279 |
| * A22-3 | * A22 | 0.17 | 14.7 | 70 | 930 | 85 | 70 | 452 | 506 | 234 | 7.6 | 0.168 | 0.251 |
| * A22-4 | | 0.27 | 14.0 | 100 | 930 | 100 | 100 | 510 | 506 | 10 | 6.1 | 0.137 | 0.163 |
| * A22-5 | | 0.27 | 14.0 | 100 | 930 | 100 | 100 | 532 | 506 | 11 | 6.1 | 0.092 | 0.195 |
| A23-1 | A23 | 0.20 | 14.5 | 70 | 925 | 100 | 100 | 515 | 469 | 7 | 6.0 | 0.038 | 0.021 |
| * A23-2 | | 0.20 | 14.5 | 70 | 925 | 100 | 1 | 510 | 469 | 813 | 6.0 | 0.041 | 0.130 |
| A24-1 | A24 | 0.20 | 14.5 | 100 | 925 | 100 | 100 | 495 | 436 | 7 | 5.4 | 0.067 | 0.012 |
| A24-2 | | 0.20 | 14.5 | 100 | 925 | 100 | 100 | 508 | 436 | 7 | 5.4 | 0.050 | 0.014 |
| A24-3 | | 0.20 | 14.5 | 100 | 925 | 100 | 100 | 521 | 436 | 7 | 5.4 | 0.035 | 0.016 |
| A25-1 | A25 | 0.20 | 14.5 | 100 | 925 | 100 | 100 | 496 | 434 | 7 | 5.8 | 0.069 | 0.011 |
| A25-2 | | 0.20 | 14.5 | 100 | 925 | 100 | 100 | 511 | 434 | 7 | 5.8 | 0.048 | 0.012 |
| A25-3 | | 0.20 | 14.5 | 100 | 925 | 100 | 100 | 522 | 434 | 7 | 5.8 | 0.032 | 0.014 |
| A26-1 | | 0.20 | 14.5 | 100 | 925 | 100 | 100 | 497 | 434 | 7 | 5.9 | 0.068 | 0.010 |
| A26-2 | A26 | 0.20 | 14.5 | 100 | 925 | 100 | 100 | 509 | 434 | 7 | 5.9 | 0.042 | 0.012 |
| A26-3 | | 0.20 | 14.5 | 100 | 925 | 100 | 100 | 518 | 434 | 7 | 5.9 | 0.039 | 0.013 |
| A27-1 | A27 | 0.17 | 14.7 | 50 | 930 | 60 | 50 | 490 | 438 | 9 | 6.8 | 0.038 | 0.011 |
| A28-1 | A28 | 0.17 | 14.7 | 50 | 930 | 60 | 50 | 492 | 449 | 9 | 6.8 | 0.047 | 0.013 |
| * A29-1 | * A29 | 0.17 | 14.7 | 50 | 930 | 60 | 50 | 471 | 453 | 8 | — | — | — |
| * A30-1 | * A30 | 0.17 | 14.7 | 50 | 930 | 60 | 50 | 472 | 445 | 8 | 9.8 | — | — |

Note:
Sample No. with "*" represents a comparative sample, while Sample No. without the said mark represents a sample according to the present invention.

TABLE 5

| Sample No. | Steel No. | Strain in wire drawing | Wire dia. after wire drawing mm | Quenching Heating rate K/sec | Quenching T1 ° C. | Quenching Cooling rate K/sec | Tempering Heating rate K/sec | Tempering Heating temperature ° C. | Tempering T2 ° C. | Tempering t1 sec | Pre-austenite grain dia. μm | Solute C content % | Compound type Cr content % |
|---|---|---|---|---|---|---|---|---|---|---|---|---|---|
| * A31-1 | | 0.17 | 14.7 | 25 | 870 | 75 | 25 | 430 | 450 | 237 | 8.0 | 0.178 | 0.070 |
| A31-2 | | 0.17 | 14.7 | 25 | 870 | 75 | 25 | 455 | 450 | 238 | 8.0 | 0.138 | 0.083 |
| * A31-3 | | 0.20 | 14.5 | 25 | 870 | 25 | 25 | 458 | 450 | 239 | — | — | — |
| A31-4 | A31 | 0.20 | 14.5 | 100 | 870 | 100 | 100 | 500 | 450 | 7 | 7.6 | 0.030 | 0.010 |
| A31-5 | | 0.20 | 14.5 | 100 | 870 | 100 | 100 | 510 | 450 | 5 | 7.6 | 0.027 | 0.011 |
| A31-6 | | 0.27 | 14.0 | 100 | 870 | 100 | 100 | 501 | 450 | 7 | 5.3 | 0.031 | 0.012 |
| A31-7 | | 0.34 | 13.5 | 100 | 870 | 100 | 100 | 501 | 450 | 7 | 3.3 | 0.033 | 0.012 |
| * A32-1 | | 0.17 | 14.7 | 2 | 875 | 75 | 1 | 350 | 447 | 3051 | 24.0 | 0.172 | 0.167 |
| * A32-2 | | 0.17 | 14.7 | 2 | 875 | 75 | 1 | 375 | 447 | 3076 | 24.0 | 0.168 | 0.185 |
| * A32-3 | | 0.17 | 14.7 | 2 | 875 | 75 | 1 | 400 | 447 | 3101 | 24.0 | 0.160 | 0.192 |
| * A32-4 | | 0.17 | 14.7 | 2 | 875 | 75 | 1 | 425 | 447 | 3127 | 24.0 | 0.155 | 0.210 |
| * A32-5 | | 0.17 | 14.7 | 25 | 875 | 70 | 25 | 400 | 447 | 235 | 9.3 | 0.168 | 0.081 |
| * A32-6 | | 0.17 | 14.7 | 25 | 875 | 70 | 25 | 420 | 447 | 237 | 9.3 | 0.161 | 0.084 |
| A32-7 | | 0.17 | 14.7 | 25 | 875 | 70 | 25 | 448 | 447 | 238 | 9.3 | 0.129 | 0.088 |
| * A32-8 | A32 | 0.06 | 15.5 | 70 | 925 | 70 | 50 | 450 | 447 | 15 | 14.0 | 0.141 | 0.012 |
| * A32-9 | | 0.06 | 15.5 | 70 | 925 | 70 | 50 | 472 | 447 | 16 | 14.0 | 0.103 | 0.013 |
| * A32-10 | | 0.06 | 15.5 | 70 | 925 | 70 | 50 | 495 | 447 | 17 | 14.0 | 0.052 | 0.014 |
| A32-11 | | 0.17 | 14.7 | 100 | 925 | 70 | 100 | 473 | 447 | 14 | 7.2 | 0.082 | 0.013 |
| A32-12 | | 0.17 | 14.7 | 100 | 925 | 70 | 100 | 495 | 447 | 15 | 7.2 | 0.041 | 0.015 |
| * A32-13 | | 0.24 | 14.2 | 100 | 1000 | 85 | 100 | 433 | 447 | 5 | 8.4 | 0.162 | 0.011 |
| A32-14 | | 0.24 | 14.2 | 100 | 1000 | 85 | 100 | 468 | 447 | 6 | 8.4 | 0.110 | 0.010 |
| A32-15 | | 0.17 | 14.7 | 100 | 1000 | 150 | 100 | 496 | 447 | 7 | 9.6 | 0.082 | 0.011 |
| A32-16 | | 0.17 | 14.7 | 100 | 1000 | 150 | 100 | 512 | 447 | 7 | 9.6 | 0.030 | 0.013 |
| * A33-1 | * A33 | 0.17 | 14.7 | 50 | 920 | 60 | 50 | 470 | 444 | 8 | — | — | — |
| * A34-1 | * A34 | 0.17 | 14.7 | 50 | 920 | 60 | 50 | 471 | 443 | 8 | 8.4 | — | — |
| * A35-1 | * A35 | 0.17 | 14.7 | 100 | 880 | 70 | 100 | 338 | 447 | 3 | 8.5 | 0.179 | 0.010 |
| * A35-2 | | 0.17 | 14.7 | 100 | 880 | 70 | 100 | 359 | 447 | 3 | 8.5 | 0.161 | 0.010 |
| * A35-3 | | 0.17 | 14.7 | 100 | 880 | 70 | 100 | 386 | 447 | 4 | 8.5 | 0.157 | 0.011 |
| * A35-4 | | 0.17 | 14.7 | 100 | 880 | 70 | 100 | 402 | 447 | 4 | 8.5 | 0.153 | 0.012 |
| * A36-1 | | — | 16.0 | 25 | 950 | 50 | 70 | 694 | 692 | 13 | 21.5 | 0.030 | 0.075 |
| * A36-2 | * A36 | 0.20 | 14.5 | 100 | 920 | 50 | 70 | 693 | 692 | 251 | 8.9 | 0.027 | 0.201 |
| * A36-3 | | 0.20 | 14.5 | 100 | 920 | 50 | 70 | 700 | 692 | 251 | 8.9 | 0.020 | 0.213 |

Note:
Sample No with "*" represents a comparative sample, while Sample No. without the said mark represents a sample according to the present invention.

TABLE 6

| Sample No. | Steel No. | Strain in wire drawing | Wire dia. after wire drawing mm | Quenching Heating rate K/sec | Quenching T1 ° C. | Quenching Cooling rate K/sec | Tempering Heating rate K/sec | Tempering Heating temperature ° C. | Tempering T2 ° C. | Tempering t1 sec | Pre-austenite grain dia. μm | Solute C content % | Compound type Cr content % |
|---|---|---|---|---|---|---|---|---|---|---|---|---|---|
| * A37-1 | | — | 16.0 | 25 | 950 | 50 | 70 | 695 | 688 | 13 | 15.7 | 0.023 | 0.070 |
| * A37-2 | * A37 | 0.17 | 14.7 | 25 | 950 | 50 | 70 | 690 | 688 | 13 | 8.9 | 0.024 | 0.070 |
| * A37-3 | | 0.20 | 14.5 | — | — | — | — | — | — | — | — | — | — |
| * A37-4 | | 0.27 | 14.0 | — | — | — | — | — | — | — | — | — | — |
| * A38-1 | | 0.27 | 14.0 | 70 | 930 | 70 | 100 | 499 | 449 | 7 | 8.8 | 0.034 | 0.012 |
| * A38-2 | * A38 | 0.27 | 14.0 | 70 | 900 | 20 | 25 | 488 | 449 | 12 | — | — | — |
| * A38-3 | | 0.27 | 14.0 | 70 | 900 | 85 | 10 | 464 | 449 | 249 | 6.4 | 0.153 | 0.121 |
| * A38-4 | | 0.27 | 14.0 | 70 | 900 | 85 | 10 | 490 | 449 | 252 | 6.4 | 0.034 | 0.134 |
| A39-1 | A39 | 0.27 | 14.0 | 70 | 930 | 70 | 100 | 532 | 486 | 8 | 8.4 | | |
| * A40-1 | * A40 | 0.27 | 14.0 | — | — | — | — | — | — | — | — | — | — |
| * A41-1 | A41 | 0.27 | 14.0 | 2 | 930 | 70 | 1 | 370 | 449 | 3071 | 28.0 | 0.178 | 0.110 |
| * A41-2 | | 0.27 | 14.0 | 2 | 930 | 70 | 1 | 385 | 449 | 3086 | 28.0 | 0.174 | 0.112 |
| * A41-3 | | 0.27 | 14.0 | 2 | 930 | 70 | 1 | 400 | 449 | 3101 | 28.0 | 0.165 | 0.118 |
| * A41-4 | | 0.27 | 14.0 | 2 | 930 | 70 | 1 | 415 | 449 | 3117 | 28.0 | 0.160 | 0.122 |
| * A41-5 | | 0.27 | 14.0 | 70 | 890 | 70 | 100 | 410 | 449 | 233 | 8.5 | 0.162 | 0.078 |
| * A41-6 | | 0.27 | 14.0 | 70 | 890 | 70 | 100 | 430 | 449 | 233 | 8.5 | 0.154 | 0.083 |
| A41-7 | | 0.27 | 14.0 | 70 | 890 | 70 | 100 | 473 | 449 | 6 | 8.5 | 0.073 | 0.011 |
| A41-8 | | 0.27 | 14.0 | 70 | 890 | 70 | 100 | 493 | 449 | 7 | 8.5 | 0.042 | 0.013 |
| * A42-1 | * A42 | 0.27 | 14.0 | — | — | — | — | — | — | — | — | — | — |
| * A43-1 | A43 | 0.13 | 15.0 | 100 | 925 | 85 | 100 | 450 | 457 | 6 | 8.0 | 0.168 | 0.010 |
| A43-2 | | 0.13 | 15.0 | 100 | 925 | 85 | 100 | 495 | 457 | 7 | 8.0 | 0.043 | 0.011 |
| A43-3 | | 0.13 | 15.0 | 100 | 925 | 85 | 100 | 510 | 457 | 7 | 8.0 | 0.035 | 0.014 |
| * A43-4 | | 0.13 | 15.0 | 100 | 925 | 85 | 25 | 464 | 457 | 249 | 8.0 | 0.123 | 0.118 |
| * A43-5 | | 0.13 | 15.0 | 100 | 925 | 85 | 25 | 485 | 457 | 250 | 8.0 | 0.040 | 0.148 |

TABLE 6-continued

| Sample No. | Steel No. | Strain in wire drawing | Wire dia. after wire drawing mm | Quenching Heating rate K/sec | Quenching T1 ° C. | Quenching Cooling rate K/sec | Tempering Heating rate K/sec | Tempering Heating temperature ° C. | Tempering T2 ° C. | Tempering t1 sec | Pre-austenite grain dia. μm | Solute C content % | Compound type Cr content % |
|---|---|---|---|---|---|---|---|---|---|---|---|---|---|
| * A43-6 | | 0.13 | 15.0 | 100 | 925 | 85 | 25 | 440 | 457 | 3008 | 8.0 | 0.154 | 0.155 |
| A44-1 | | 0.17 | 14.7 | 100 | 875 | 85 | 100 | 504 | 437 | 7 | 7.8 | 0.030 | 0.024 |
| * A44-2 | A44 | 0.17 | 14.7 | 100 | 875 | 85 | 25 | 500 | 437 | 251 | 7.8 | 0.028 | 0.156 |
| * A44-3 | | 0.17 | 14.7 | 100 | 840 | 85 | 100 | 508 | 437 | 7 | — | — | — |
| * A45-1 | * A45 | 0.17 | 14.7 | 100 | 930 | 70 | 25 | 474 | 435 | 239 | 7.4 | — | — |
| * A46-1 | * A46 | 0.17 | 14.7 | 100 | 930 | 70 | 25 | 470 | 446 | 239 | 7.4 | 0.118 | 0.088 |

Note:
Sample No. with "*" represents a comparative sample, while Sample No. without the said mark represents a sample according to the present invention.

The invention claimed is:

1. A high strength spring steel superior in brittle fracture resistance, comprising the following chemical components in mass %:

C: 0.4-0.6%;
Si: 1.4-3.0%;
Mn: 0.1-1.0%;
Cr: 0.2-2.5%;
P: 0.025% or less;
S: 0.025% or less;
N: 0.006% or less;
Al: 0.1% or less;
O: 0.0030% or less;
with the remainder being Fe and inevitable impurities,
wherein the amount of solute C is 0.15% or less, the amount of Cr contained as a Cr-containing precipitate is 0.10% or less, a TS value represented by the following equation is 24.8% or more, and the pre-austenite grain diameter is 10 μm or less, and
wherein $$TS=28.5*[C]+4.9*[Si]+0.5*[Mn]+2.5*[Cr]+1/7*[V]+3.7*[Mo],$$

where [X] stands for mass % of element X
further comprising, as chemical components, one or more elements selected from the group consisting of:
Mg: 0.1-100 ppm; Ca: 0.1-100 ppm; and REM: 0.1-1.5 ppm.

2. The high strength spring steel according to claim 1, further comprising, as chemical components, one or two elements selected from:
B: 100 ppm or less; and
Mo: 1.0% or less.

3. The high strength spring steel according to claim 1, further comprising, as chemical components, one or two elements selected from:
Ni: 1.0% or less; and
Cu: 1.0% or less.

4. The high strength spring steel according to claim 1, further comprising, as chemical components, one or more elements selected from the group consisting of:
V: 0.3% or less;
Ti: 0.1% or less;
Nb: 0.1% or less; and
Zr: 0.1% or less.

5. The high strength spring steel according to claim 1, wherein said steel comprises Mg: 0.1-100 ppm.

6. The high strength spring steel according to claim 1, wherein said steel comprises Ca: 0.1-100 ppm.

7. The high strength spring steel according to claim 1, wherein said steel comprises REM: 0.1-1.5 ppm.

8. The high strength spring steel according to claim 1, wherein said steel has a tensile strength of 1900 MPa or more.

9. The high strength spring steel according to claim 1, wherein said Si content is 1.9-3.0%.

10. The high strength spring steel according to claim 1, wherein said Si content is 1.4-2.5%.

11. The high strength spring steel according to claim 1, wherein said Mn content is 0.2 to 0.4 wt. %.

12. The high strength spring steel according to claim 1, wherein said Cr content is 0.4 to 2.0 wt. %.

13. The high strength spring steel according to claim 1, wherein said P content is 0.01% or less.

14. The high strength spring steel according to claim 1, wherein said S content is 0.010% or less.

15. The high strength spring steel according to claim 1, wherein said N content is 0.004% or less.

16. The high strength spring steel according to claim 1, wherein said Al content is 0.05% or less.

17. The high strength spring steel according to claim 1, wherein said O content is 0.0015% or less.

18. The high strength spring steel according to claim 1, wherein said solute C content is 0.07% or less.

19. The high strength spring steel according to claim 1, wherein said compound type Cr content is 0.06% or less.

20. A method for manufacturing a high strength spring steel superior in the brittle fracture resistance, comprising the steps of:

subjecting a steel having the chemical components described in claim 1 to a plastic working of 0.10 or more in true strain;
thereafter, subjecting the steel to a quenching treatment involving heating the steel to a temperature T1 of 850° to 1100° C. at an average heating rate at 200° C. or higher of 20 K/s or more and then cooling the steel to a temperature of 200° C. or lower at an average cooling rate of 30 K/s or more; and
subsequently subjecting the steel to a tempering treatment involving heating the steel to a temperature of T2° C. or higher determined by the following equation at an average heating rate at 300° C. or higher of 20 K/s or more and then cooling the steel to a temperature of 300° C. or lower at a residence time t1 at 300° C. or higher of 240 sec. or less,
wherein $T2=8*[Si]+47*[Mn]+21*[Cr]+140*[V]+169*[Mo]+385$ where [X] stands for mass % of element X.

* * * * *